US005365320A

United States Patent [19]

Takano et al.

[11] Patent Number: 5,365,320

[45] Date of Patent: Nov. 15, 1994

[54] SHEET WARP PREVENTION MECHANISM EMPLOYED IN A FIXING UNIT OF AN ELECTROPHOTOGRAPHIC PRINTER

[75] Inventors: Masatoshi Takano, Akikawa; Masakazu Hirano, Tokyo, both of Japan

[73] Assignee: Asahi Kogaku Kogyo Kabushiki Kaisha, Tokyo, Japan

[21] Appl. No.: 55,758

[22] Filed: May 3, 1993

Related U.S. Application Data

[63] Continuation of Ser. No. 678,139, Apr. 1, 1991, abandoned.

[30] Foreign Application Priority Data

Mar. 30, 1990 [JP] Japan ..... 2-85976

[51] Int. Cl.[5] ..... G03G 15/20

[52] U.S. Cl. ..... 355/282; 219/216; 355/290; 355/309

[58] Field of Search ..... 355/282, 290, 295, 308, 355/309, 316; 219/216, 469–471; 92/45, 7

[56] References Cited

U.S. PATENT DOCUMENTS

| | | | |
|---|---|---|---|
| 4,147,501 | 4/1979 | Goshima et al. | 355/282 X |
| 4,188,109 | 2/1990 | Idenawa et al. | 355/282 |
| 4,309,591 | 1/1982 | Kanoto et al. . | |
| 4,339,194 | 7/1982 | Scribner | 355/295 |
| 4,341,458 | 7/1982 | Glasa et al. | 355/290 |
| 4,420,680 | 12/1983 | Itoh | 219/216 X |
| 4,642,659 | 2/1987 | Nagashima et al. | 346/76 PH |
| 4,772,913 | 9/1988 | Watanabe . | |
| 4,912,490 | 3/1990 | Negoro et al. . | |
| 4,924,266 | 5/1990 | Negoro et al. . | |
| 4,949,104 | 8/1990 | Negoro et al. . | |
| 4,967,237 | 10/1990 | Sasaki et al. | 355/290 |
| 4,998,835 | 3/1991 | Negishi et al. . | |
| 5,023,667 | 6/1991 | Negoro et al. . | |
| 5,070,373 | 12/1991 | Fukano et al. | 355/290 |
| 5,170,214 | 12/1992 | Negoro et al. | 355/283 |

FOREIGN PATENT DOCUMENTS

| | | |
|---|---|---|
| 2930021 | 5/1988 | Germany . |
| 3842745 | 7/1989 | Germany . |

*Primary Examiner*—A. T. Grimley
*Assistant Examiner*—Shuk Y. Lee
*Attorney, Agent, or Firm*—Sandler, Greenblum & Bernstein

[57] ABSTRACT

In a sheet warp prevention mechanism adapted to be positioned in an imaging device for forming a visible image, the imaging device includes a pair of rollers adapted to be brought into and out of contact with each other in accordance with a rocking operation of one of the pair of rollers about a predetermined shaft member. The one of the pair of rollers which is arranged to be rotated in a predetermined direction for feeding the continuous sheet has a gear member coaxially provided therewith which is brought into engagement with another gear member coaxially provided with the shaft member about which the roller rotates. A driving source for driving both the one of the pair of rollers and a feeding member for feeding the continuous sheet toward the pair of rollers, and a transmitting mechanism for transmitting the driving force toward the pair of rollers is also included. The sheet warp prevention mechanism include an inhibiting member, provided between the transmitting mechanism and the another gear member, for inhibiting transmission of the rotating force of the one of the pair of rollers to the transmitting mechanism. Thus it becomes possible to prevent the warp of the sheet caused by an undesirable feeding operation.

21 Claims, 8 Drawing Sheets

SHEET WARP PREVENTION MECHANISM EMPLOYED IN A FIXING UNIT OF AN ELECTROPHOTOGRAPHIC PRINTER

This application is a continuation of application Ser. No. 07/678,139, filed Apr. 1, 1991, now abandoned.

BACKGROUND OF THE INVENTION

The present invention relates to a sheet warp prevention mechanism, employable to an image forming apparatus such as a printer and the like utilizing a so-called continuous-form sheet as a recording medium and including a pair of fixing rollers adapted to be brought into and out of contact with each other, for preventing the continuous-form sheet from being warped when the rollers are brought into contact with each other.

Conventionally known is an electrophotographic method in which a photoconductive material on a rotating drum, i.e., a photoconductive drum, which has been evenly charged, is exposed to light in accordance with an image to be developed for forming a latent image. Toner particles are adhered onto a surface of the drum for forming a visible toner image, and the-toner image is transferred onto a continuous-form sheet having been fed along a predetermined feeding path and fixed thereon at a fixing unit.

Also known is an electrophotographic printer, as an image forming apparatus employing the above electrophotographic method, utilizing a fan-folded continuous-form sheet used in a conventional line printer and the like. The fan-folded continuous-form sheet, simply referred to as "continuous sheet" hereinafter, is arranged to provide, at both side edges, a pair of sprocket holes in predetermined intervals along a longitudinal direction thereof. Further, on the continuous sheet, a plurality of perforated lines are provided along a width direction in another predetermined interval so that the continuous sheet is easily cut into pages.

In the conventional image forming apparatus such as the above arranged electrophotographic printer, the method for fixing a toner image having been transferred onto the continuous sheet is a so-called heat roll fixing method in which the continuous sheet is pressurized by means of a heat roller which is arranged to be heated up to a predetermined high temperature, and the toner image is fixed by heat from the heat roller.

A heat roll fixing unit for the above fixing method comprises a pair of rollers arranged to be positioned in parallel and to be brought into and out of contact with each other, and the continuous sheet is fed through the rollers. One of the rollers is arranged to be heated up, referred as "heat roller" hereinafter, by a predetermined heating member such as a halogen lamp, not shown accommodated within the heat roller. In other words, the continuous sheet is pressurized with heat when passed between the heat roller and the other roller, referred to as the "press roller" hereinafter, and therefore, toner image is fixed on the continuous sheet. The press roller is made of an elastic material and is arranged to be compressed in a radial direction thereof when pressurized by the heat roller. By employing the above Fixing method, it becomes possible to fix the toner image at high speed with high thermal efficiency. Usually, the heat roller is driven to be rotated so that the continuous sheet is fed along the predetermined feeding path at the fixing unit.

When the heat roll fixing method is employed in the electrophotographic printer using the above continuous-sheet as the recording medium, a problem arises in that when the continuous-sheet is held between the rollers without feeding, the same portion on the continuous sheet is burned or blistered by the heat applied from the heat roller. In order to overcome the problem, a fixing unit has been proposed, wherein one of the rollers can be retracted from the contacted state for preventing the continuous sheet from being contacted with the heat roller when the printing operation is not to be executed, see, for example, Japanese Patent Provisional Publication No. HEI 1-163790.

As shown in FIG. 1, this type of fixing unit 10 comprises a heat roller 11 and a press roller 12 between which a continuous sheet 20 is fed along a direction as indicated by an arrow "A". The heat roller 11 is supported by an arm member 13 which is arranged to be rocked as indicated by an arrow "B" by means of a well-known rocking mechanism. For example, as shown in FIG. 2A, it may be constructed that a rotating shaft 11-1 of the heat roller 11 is connected to a cam follower 101 arranged to be movable with a cam 102 having a long radius portion 110 as well as a short radius portion 120. The cam 102 is arranged to be driven to rotate by means of a driving source 103, such as a motor. The rotating shaft 11-1 of the heat roller 11 is inserted into an oval hole 11-2 provided on a chassis 11-3 of the printer, so that the cam follower 101 is vertically moved in accordance with rotation of the cam 102. Therefore, the heat roller 11 is rocked along the "B" direction. When the cam follower 101 is contacted with the long radius portion 110 of the cam 11C, the rollers 11, 12 are brought out of contact from each other. On the other hand, when the cam follower 11B is contacted with the short radius portion 120, the rollers 11, 12 are brought into contact with each other. When the arm member 13 is upwardly rocked, the heat roller 11 is upwardly rocked too, and the heat roller 11 and the press roller 12 are brought out of contact from each other.

The press roller 12 is upwardly biased toward the heat roller 11 by means of a predetermined biasing member such as a spring 14, so that the heat roller 11 downwardly pushes the press roller 12 against the biasing force of the spring 14 when the heat roller 11 and the press roller 12 are brought into contact with each other, i.e., the heat roller 11 is located at an operating position, and therefore, a predetermined pressure force is generated between the rollers 11, 12.

In this type of printer, an interval between an operating position of the fixing unit 10, at which the rollers 11, 12 are brought into contact with each other, and a transfer position of the photoconductive drum (not shown), at which the toner image is transferred to the continuous sheet, is arranged to be substantially similar to an interval between two adjacently located perforated lines of the continuous sheet 20, i.e., length of one page so that a fixing operation for one page is simultaneously finished with a transfer operation for the succeeding page. In order to stably feed the continuous sheet 20, there is provided a tractor 2 between the fixing unit 10 and the photoconductive drum.

The tractor 2 and the fixing unit 10 are driven to feed the continuous sheet 20 by the same driving source 3, such as a step motor, since the continuous sheet is to be synchronously fed by the fixing unit 10 and the tractor 2.

A gear 3B is driven to be rotated along a direction indicated by an arrow "C" by an output gear 3A provided within the driving source 3, and a tractor driving system 4 including a pair of gears 41, 42, which are respectively arranged to be rotated along directions indicated by arrows "C1" and "C2", is driven through the gear 3B so that a tractor belt 21 on which the continuous sheet 20 is located is moved along a direction indicated by an arrow "D" by means of a pulley 42A which is coaxially arranged in an extremely close positional relationship with the gear 42A. On the other hand, a heat roller driving system 5 is simultaneously driven through the gear 3B. The gear 3B and 41 are, in fact, coaxially provided with each other in an extremely close positional relationship though the gears 3B, 41 are illustrated in a separated state in FIG. 1. In FIG. 1, positional relationships among each of elements are schematically illustrated for better understanding. The heat roller driving system comprises a timing pulley 51 which is coaxially provided with the gear 41 in an extremely close positional relationship, a timing belt 52 arranged to be driven to move by the timing pulley 51, another timing pulley 53 to be rotated through the timing belt 52, a gear 54 to be rotated by the timing pulley 53, an idle gear 55 to be brought into engagement with the gear 54 and arranged to be coaxially provided with the rocking center of the arm member 13, and a heat roller gear 56 which is coaxially provided with the heat roller 11 and arranged to be brought into engagement with the idle gear 55.

In other words, the heat roller 11 is arranged to be rocked in accordance with the rocking operation of the arm member 13, and the heat roller driving system 5 for driving the heat roller 11 are arranged to transmit drive force from the driving source 3 toward the heat roller through the idle gear 55 which is coaxially provided with the rocking center of the arm 13.

In this above-described arrangement in which the heat roller 11 is rocked by means of the arm member 13 and driven to be rotated through the idle gear 55 which is coaxially provided with the rocking center of the arm member 13, however, a problem arises in that the continuous sheet 20 between the photoconductive drum and the fixing unit 10 is slightly warped upwardly when the heat roller 11 having been separated from the operating position is rocked and brought into contact with the press roller 12.

The reasons for the above-described sheet warp are as follows: first, the idle gear 55 is connected to the driving source 3 as well as the tractor driving system 4 when the heat roller 11 is rocked and located at the operating position. Rotary resistance as a load, in this state, becomes large when the arm 13 is rocked. Therefore, the heat roller gear 56 which is constantly brought into engagement with the idle gear 55 is rotated in the opposite direction of the sheet feeding direction. That is, the heat roller 11 which is coaxially provided with the heat roller gear 56 is slightly rotated in the opposite direction, so that the continuous sheet is reversely fed in accordance with the reverse rotation of the heat roller gear 56, and accordingly, the continuous sheet 20 is slightly warped upwardly between the photoconductive drum and the fixing unit 10.

Further, as the heat roller 11 is rocked and located at the operating position, i.e., brought into contact with the press roller 12, the pressure force generated between the rollers 11, 12 becomes larger than a predetermined value since the press roller 12 is slightly compressed by the heat roller 11 and the spring 14 is slightly pushed downwardly against elastic force therof. Therefore, if the pressure force becomes larger than the predetermined value, rotary resistance of the heat roller gear 56 extremely increases and the heat roller 11 can not be rotated even when the arm member 13 is rocked. As a result, both the arm 13 and the heat roller gear 56 are slightly moved in a downward direction, and the idle gear 55 is relatively moved in an upward direction. In other words, the idle gear 55 is operated as if it were a planetary gear arranged to be rotated around the heat roller gear 56. Since the idle gear 55 is undesirably rotated in a direction indicated by an arrow "E", i.e., a direction corresponding to the sheet feeding direction, in accordance with the rocking operation of the arm member 13, and the tractor 2 is slightly driven to feed the continuous sheet 20 toward the fixing unit 10. In other words, the tractor 2 is undesirably driven by the rotation of the idle gear 55 to feed the continuous sheet 20 in the sheet feeding direction, rather than solely by the driving source 3. Accordingly, the continuous sheet 20 is fed by the tractor 2 without a feeding operation of the fixing unit 10, so that the continuous sheet 20 is further upwardly warped.

Further, when the tractor 2 is driven to feed the sheet in the sheet feeding direction by the rotation of the idle gear 55 as described above, so-called play among the elements in the heat roller driving system 5, such as backlash between each of elements provided from the gear 3B to the heat roller gear 56 through the idle gear 55, are shortened by movement of each of driven side elements 1000 as shown in FIG. 2B. On the other hand, play among the elements in the tractor driving system 4, i.e., elements provided from the gear 3B to the tractor 2, are shortened by movement of each of the driving side elements 2000 as shown in FIG. 2C. Character "a" in FIGS. 2B and 2C indicates a direction corresponding to the sheet feeding direction. As a result, when the driving force form the driving source 3 is applied, the tractor 2 is immediately started to feed the continuous sheet 20, however, the heat roller 11 is not driven to rotate so immediately since it is necessary to elapse a predetermined period of time for shortening the play in the heat roller driving system 5 in the sheet feeding direction. Therefore, the continuous sheet 20 is further upwardly warped.

Consequently, when the continuous sheet 20 is upwardly warped by the above-described reasons, the warped continuous sheet 20 is contacted with an element 6 such as a chassis and the like provided above the feeding path of the continuous sheet 20, and the toner image on the continuous sheet 20, which has not been fixed yet, is disturbed by the element 6. Further, since the continuous sheet 20 is fed into the fixing unit 10 in a warped state, wrinkles occur thereon.

SUMMARY OF THE INVENTION

It is therefore an object of the invention to provide a sheet warp prevention mechanism capable of preventing a continuous sheet employed in an electrophotographic printer and the like from being warped when a heat roller is located at an operating position and the continuous sheet is started to be fed, so that it becomes possible to avoid disturbance of the toner image caused by a contact operation of the warped sheet with an element provided within the printer, and the wrinkles of the continuous sheet caused when pressurized in the warped state.

For this purpose, according to the present invention, there is provided a sheet warp prevention mechanism adapted to be positioned in an imaging device for forming a visible image by an electrophotographic method. The imaging device includes a pair of rollers adapted to be brought into and out of contact with one each other in accordance with a rocking operation of one of the pair of rollers about a predetermined shaft member for fixing a toner image having been formed on a continuous sheet. The one of the pair of rollers which is arranged to be rotated in a predetermined direction for feeding said continuous sheet with a gear member coaxially provided therewith which is brought into engagement with another gear member that is coaxially provided with the shaft member. A driving source member for driving both the one of the pair of rollers and a feeding member for feeding the continuous sheet toward the pair of rollers is provided, as well as a transmitting mechanism for transmitting the driving force toward the pair of rollers.

The sheet warp prevention mechanism includes an inhibiting member, provided between the transmitting mechanism and another gear member, for inhibiting a transmission of rotating force from the movable one of the pair of fixing rollers to the transmitting mechanism.

DESCRIPTION OF THE ACCOMPANYING DRAWINGS

DESCRIPTION OF THE EMBODIMENTS

Figure 1:
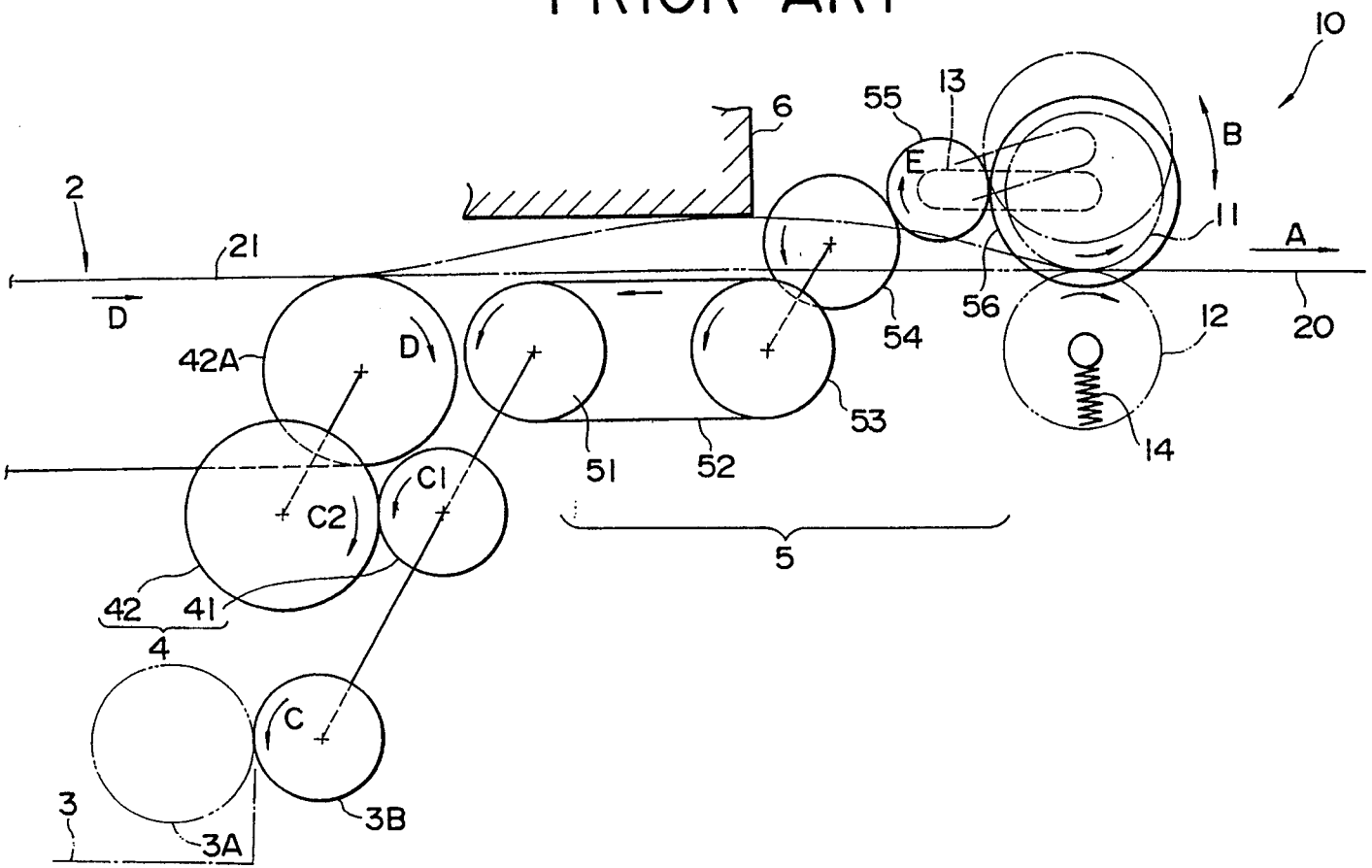
FIG. 1 PRIOR ART
FIG. 1 shows a schematic arrangement of a fixing unit and a tractor for feeding a continuous sheet thereto arranged to be driven by a conventional driving mechanism.
Figure 2A:
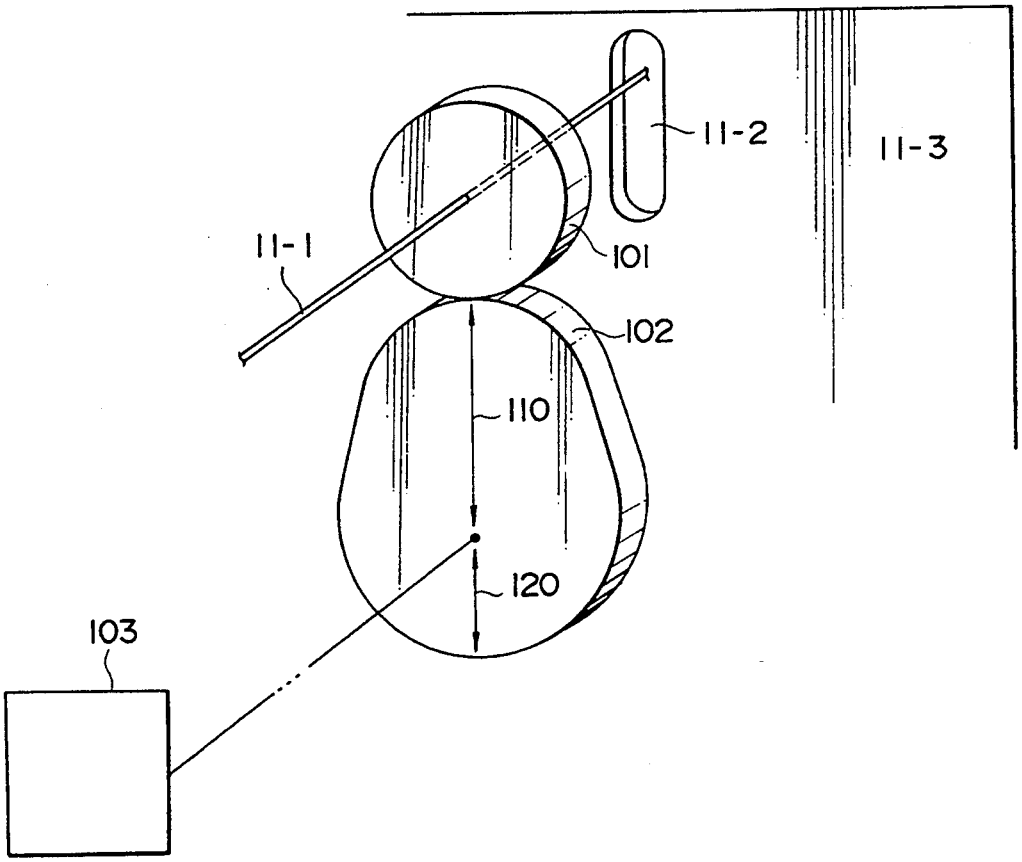
FIG. 2A shows a side view of a rocking mechanism, employable to the fixing unit shown in FIG. 1, for rocking a heat roller.
Figure 2B:
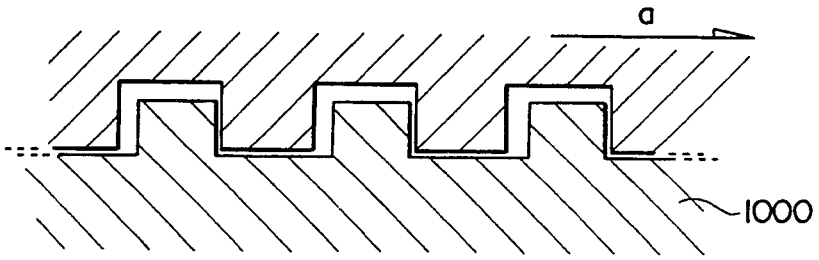
FIGS. 2B and 2C are explanatory views for explaining an operation of backlash between two elements.
Figure 2C:
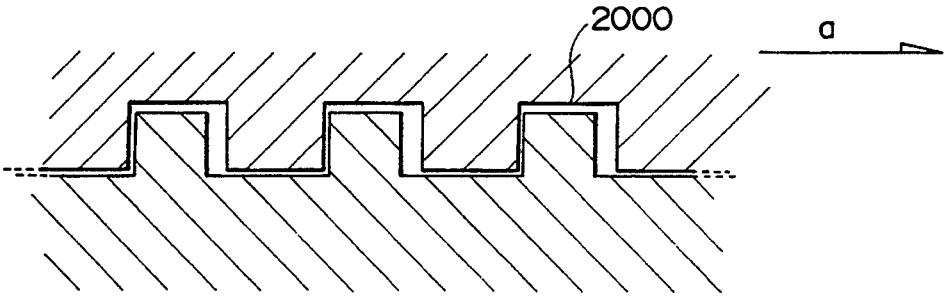
Figure 3:
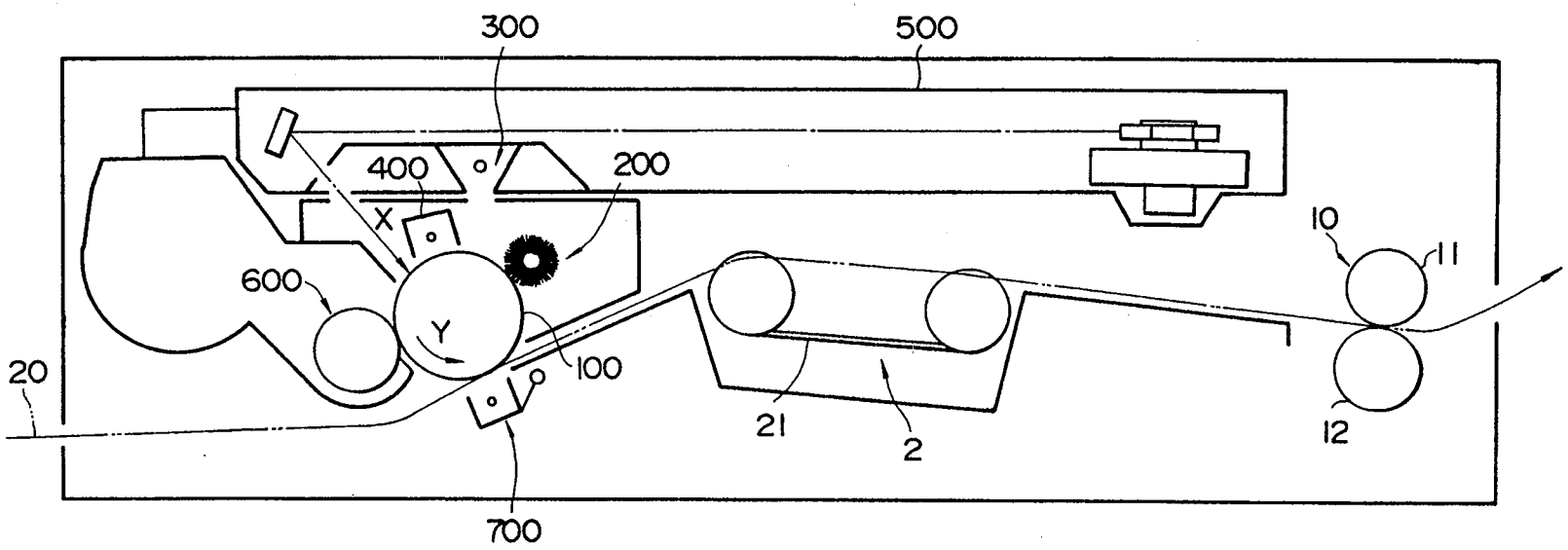
FIG. 3 shows a side view showing an electrophotographic printer employing a heat roller fixing unit having a sheet warp prevention mechanism according to the present invention.

FIG. 3 shows a laser beam printer, using a continuous-form fan-folded sheet as a recording medium, by which character information inputted from an external computer and the like (not shown) are printed on the continuous sheet 20 by a so-called electrophotographic system.

A toner cleaning unit 200, a discharging unit 300, a charging unit 400, a scanning optical system 500 for introducing a laser beam to a photoconductive drum 100 as indicated by an arrow "X", a development unit 600, and a transfer unit 700 are disposed, respectively around the photoconductive drum 100 along a rotating direction thereof indicated by an arrow "Y". Further, a fixing unit 10 is disposed at the downstream side of the photoconductive drum 100, and a tractor 2 through which the continuous sheet 20 is fed toward the fixing unit 10 is disposed as shown in FIG. 3. The tractor 2 includes a pair of tractor belts 21, 21 each having a projections, not shown, to be fitted with a plurality of sprocket holes provided on both side edges of the continuous sheet 20.

In this above-described laser beam printer, a circumferential surface of the photoconductive drum 100 is charged at the charging unit 400, and as the photoconductive drum 100 rotated along the "Y" direction, a circumferential surface thereof is scanned by the laser beam modulated by image information to be developed to form an electrostatic latent image, toner is adhered to the surface of the photoconductive drum 1 at the development unit 600 for forming a visible toner image, the toner image is transferred onto the continuous sheet 20 at the transfer unit 700 and fixed at the fixing unit 10.

With reference to FIGS. 3 through 7, embodiments of the sheet warp prevention mechanism according to the present invention will be described hereinafter.

Figure 4:
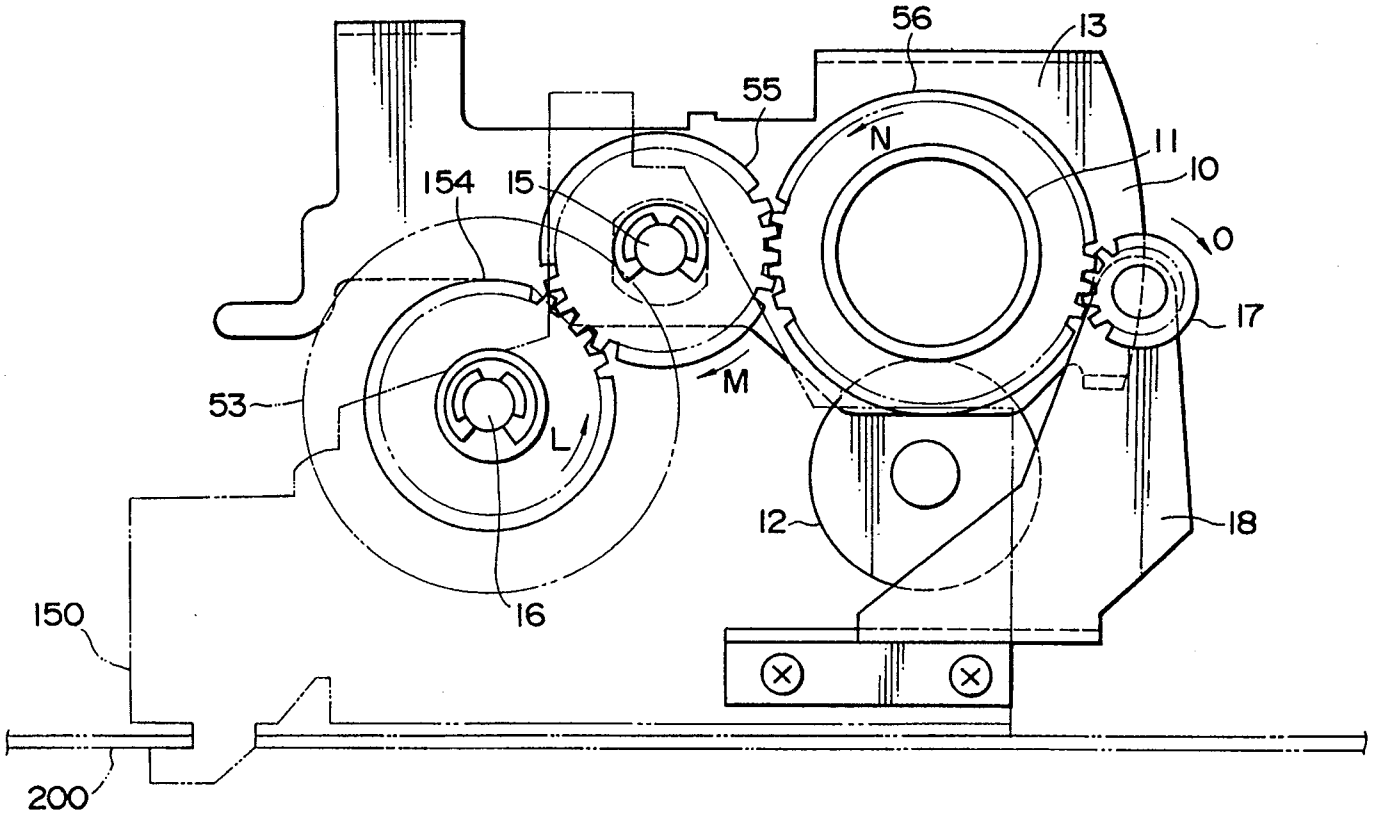
FIG. 4 shows a side view of a heat roller fixing unit having one embodiment of the sheet warp prevention mechanism according to the present invention.
Figure 5:
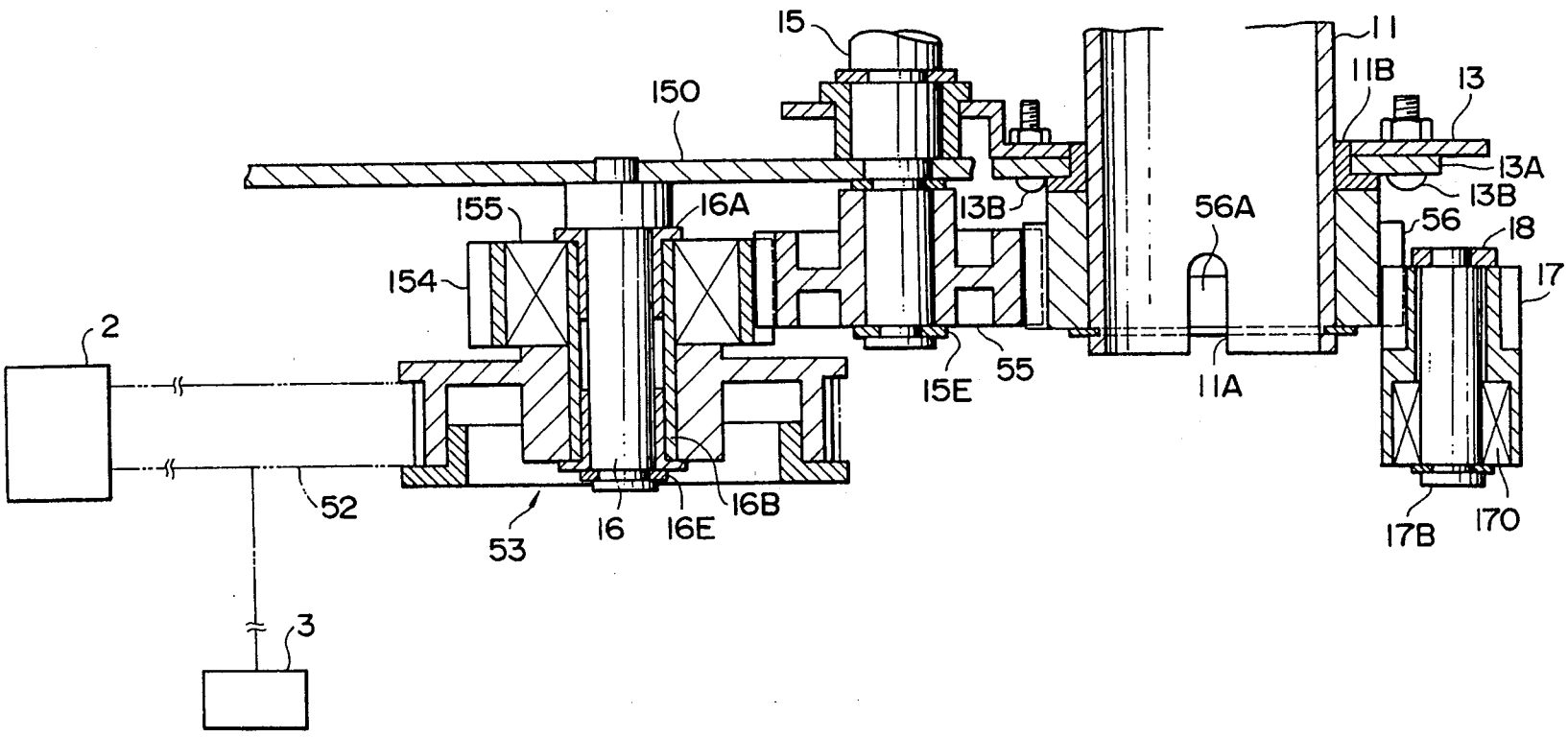
FIG. 5 shows a sectional plane view of the heat roller fixing unit shown in FIG. 4.

FIG. 4 shows a side view of a heat roller fixing unit having one embodiment of the sheet warp prevention mechanism according to the present invention and FIG. 5 shows a sectional plane view of the heat roller fixing unit shown in FIG. 4.

The heat roller 11 included in the fixing unit 10 is rotatably supported by a bearing 11B and held by a pair of arm members 13, 13 at both side portions thereof. Only one arm member is represented in the drawings of FIGS. 4 and 5. In order to hold the heat roller 11, a holding member 13A is fixed to the arm member 13 by means of a pair of screws 13B. The arm member 13 is arranged to be rocked about a shaft 15 provided on a fixing unit chassis 150, so that the heat roller 11 is upwardly rocked in accordance with a rocking operation of the arm 13 along a counterclockwise direction in the drawing of FIG. 4 and separated from an operating position at which it is brought into contact with a press roller 12. The fixing unit chassis 150 is arranged to be detachably mounted on a base plate 200 of the electrophotographic printer. In other words, the fixing unit 10 is detachable from the electrophotographic printer.

On one side edge of the heat roller 11, a heat roller gear 56 is coaxially provided therewith by means of a uniform section C-type retaining ring 11C. The idle gear 55 which is fixed to the shaft 15 by a E type retaining ring 15E is brought into engagement with the heat roller gear 56 as well as a gear 154.

On an inner circumferential surface of the heat roller gear 56, a stopper 56A is formed to be brought into engagement with a notch 11A of the heat roller 11 provided on the edge portion thereof, so that the heat roller gear 56 is arranged not to be relatively rotated with the heat roller 11. Since the heat roller 11 is arranged to be heated up to a high temperature by a heater element such as a halogen lamp (not shown) and since heat roller 11 expands when heated, dimensions in an engagement portion of the stopper 56A and the notch 11A include margins for thermal expansion of the heat roller 11.

Gear 154 including a one-way clutch structure 155 is coaxially provided on another shaft 16. A bearing 16A and a sleeve 16B are provided around the another shaft 16 and fixed by an E type retaining ring 16E thereto. A timing pulley 53 is further rotatably provided on the shaft 16 coaxially and the shaft 16 is rotatably provided on the chassis 150. The one-way clutch structure 155 is arranged to be rotatable along one direction, while not to be rotatable along the opposite direction. In this embodiment, the one-way clutch 155 is arranged to transmit driving force of the timing pulley 53 in a direction indicated by an arrow "L", in FIG. 4, to the gear 154. Accordingly, driving force from the timing pulley 53 is transmitted to the gear 154 and the idle gear 55 is further driven to be rotated. However, driving force from the idle gear 55 is not transmitted to the timing pulley 53. The timing pulley 53 is connected to a driving source 3, such as a step motor, through a timing belt 52. In other words, even when the heat idle gear 55 is undesirably rotated, driving force caused by the rotation is not transmitted toward a driving system including the timing belt 52, driving source 3 and the like.

In this above-described arrangement, when driving force is applied to the timing pulley 53 and rotated counterclockwise, i.e., "L" direction, in the drawing of FIG. 4, the driving force is transmitted to the gear 154 through the one-way clutch 155 and the idle gear 55 is rotated in a direction indicated by an arrow "M", finally, the heat roller 11 is driven to be rotated in a direction indicated by an arrow "N". On the other hand, even when either the idle gear 55 or the heat roller 56 is undesirably rotated in the above direction by any reason, the one-way clutch 155 is not brought into engagement with the gear 154 and the rotation is not transmitted to the timing pulley 53.

Further, another gear 17 is provided in such a manner that it is brought into engagement with the heat roller gear 56 when the heat roller 11 is located at the operating position. The gear 17 is supported by a bracket 18 fixed on the chassis 150, by means of a shaft 17B, through a one-way clutch structure 170 of the gear 17 which is arranged to freely rotate the gear 17 in a direction indicated by an arrow "O" in the drawing of FIG. 4, i.e., the direction in which the continuous sheet 20 is correctly fed with a fixing operation, while not to rotate the gear 17 in the opposite direction. In other words, the heat roller 11 is rotated in the sheet feeding direction, while rotation of a reverse direction thereof is inhibited by means of the one-way clutch structure 170.

In this above-described arrangement, when the heat roller 11 is located at the operating position in accordance with the rocking operation of the arm member 13, the reverse rotation of the heat roller 11, i.e., the reverse rotation of the heat roller gear 56 in accordance with the reverse rotation of the idle gear 55 is inhibited by means of the one-way clutch structure 170. The gear 17 is provided on the chassis 150 through the one-way clutch structure 170 and arranged to be brought into engagement with the heat roller gear 56 when the heat roller 11 and the press roller 12 are brought into contact with each other. Timing of an engagement between the heat roller gear 56 and the gear 17 is arranged to be occurred before a contact operation between the heat roller 11 and the press roller 12. In other words, since the heat roller 11 is previously set so as not to be rotated in the reverse direction, the continuous sheet 20 is not reversely fed when the heat roller 11 and the press roller 12 are brought into contact.

After the heat roller gear 56 and the gear 17 are brought into engagement with each other and the heat roller 11 and the press roller 12 are contacted with each other, the heat roller 11 is set so as not to be reversely rotated and the heat roller gear 56 is slightly rotated in the "N" direction. Accordingly, warp occurrence of the continuous sheet 20 is reduced, and the continuous sheet 20 is fed only in the "A" direction and discharged from the electrophotographic printer. In this state, play in the engagement portion of the stopper 56A and the notch 11A is shortened along a direction in which the continuous sheet 20 is fed.

With a rotation of the heat-roller 11 in the "N" direction, i.e., a rotation of the heat roller gear 56 in the "N" direction, the idle gear 55 is driven to rotate in the "M" direction arid the gear 154 is driven to rotate in the "L" direction, however, the gear 154 is not rotated since the one-way clutch 155 is not arranged to transmit driving force from the idle gear 55 to the gear 54. Accordingly, the timing pulley 53 is not driven to rotate and the driving force caused by the rotation of the heat roller 11 is not transmitted to the tractor 2 and the driving system including the timing belt 52, driving source 3 and the like.

In other words, since the heat roller 11 is prevented from reversely rotating by the gear 17 and the one-way clutch structure 170, the continuous sheet 20 is prevented from being reversely fed when the heat roller 11 is contacted with the press roller 12 in accordance with the rocking operation of the arm member 13. Further, when the heat roller 11 is undesirably driven to rotate in the sheet feeding direction by a certain reason, for example, the play in the engagement portion of the stopper 56A and the notch 11A is shortened in the sheet feeding direction, driving force caused by rotation of the heat roller 11 is transmitted to the idle gear 55 to rotate. However, since the one-way clutch structure 155 is provided between the idle gear 55 and the gear 154, the driving force is not transmitted to the gear 54 and the timing pulley 53 is not driven to rotate. Accordingly, the driving force is prevented from being transmitted to the tractor 2 driving system including the timing belt 52, driving source 3 and the like.

Accordingly, warps of the continuous sheet 20 caused by the reverse rotation of the heat roller 11 between the photoconductive drum 100 and the fixing unit 10, caused by the undesirable feeding operation of the tractor 2 driven by the driving force undesirably transmitted from the heat roller to the driving system and the tractor 2, are reduced. Further, since the driving force is not transmitted to the driving system and the driving source 3, shortening of play by the movement of the driven side elements are reduced.

Figure 6:
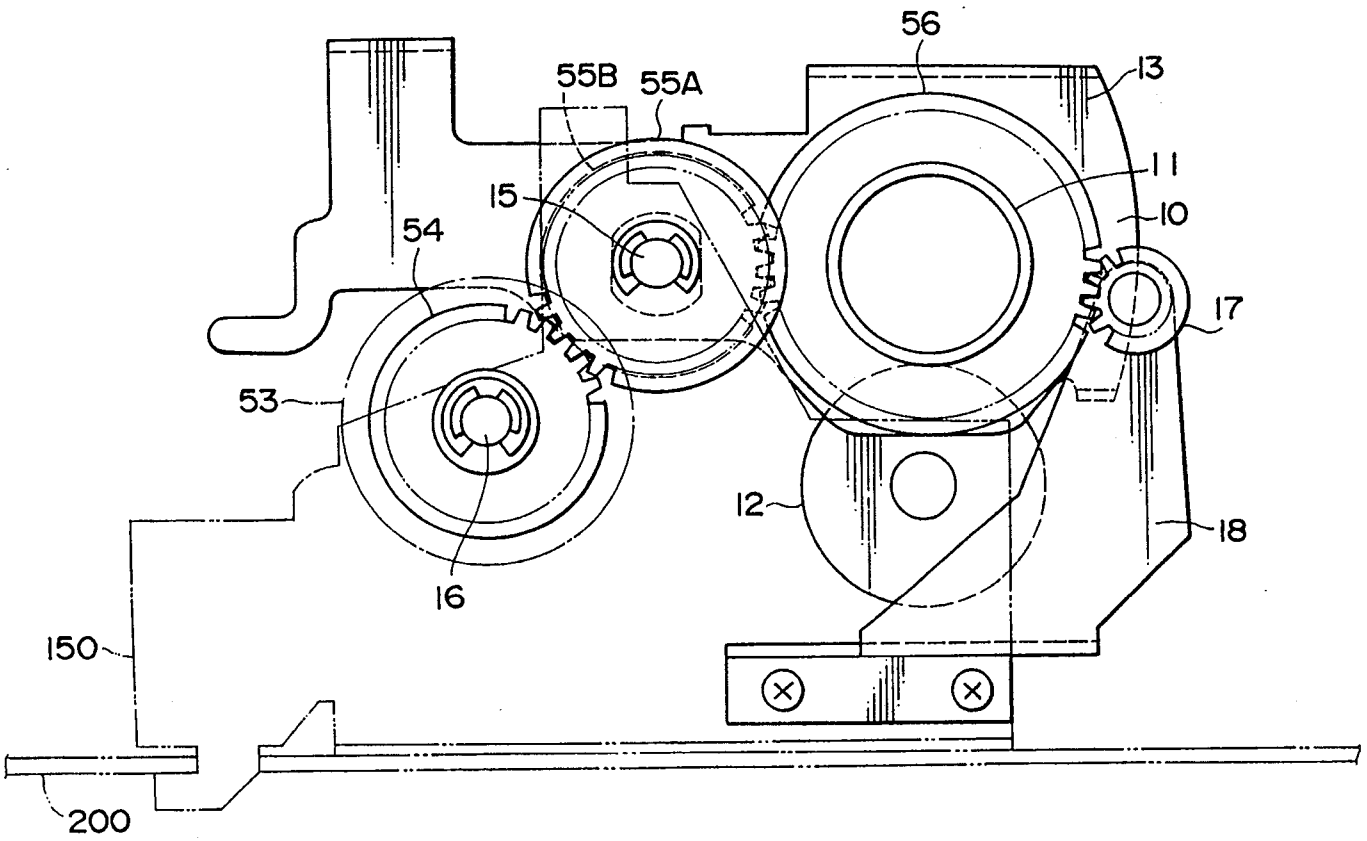
FIG. 6 shows a side view of a heat roller fixing unit having another embodiment of the sheet warp prevention mechanism according to the present invention.
Figure 7:
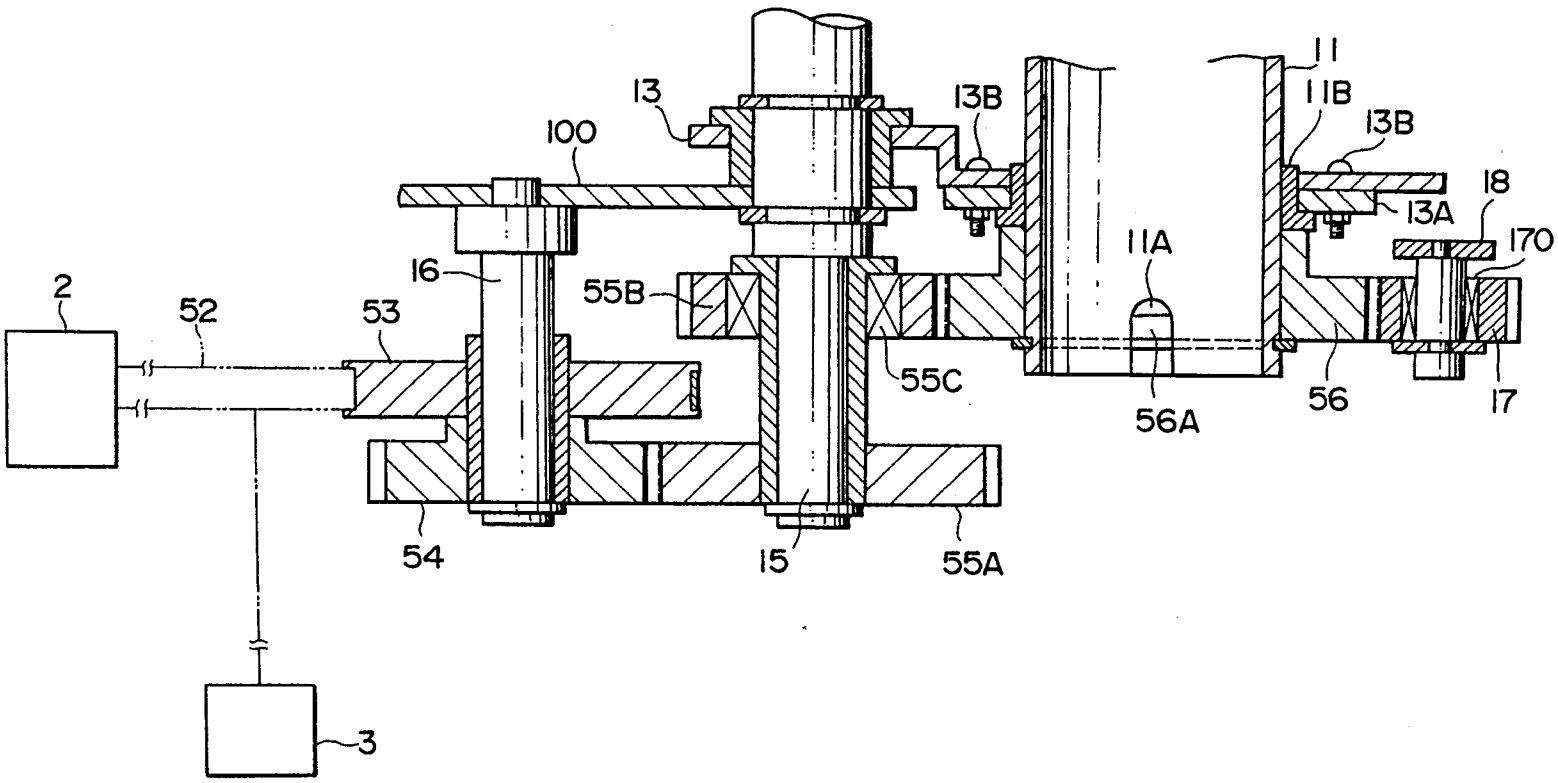
FIG. 7 shows a sectional plane view of the heat roller fixing unit shown in FIG. 6.

In this above-described embodiment, the one-way clutch 155 structure is provided between the gear 154 and the timing pulley 53 coaxially provided on the shaft 16. However, a position at which the one-way clutch structure 155 is provided is not limited to that position. For example, as indicated in FIGS. 6 and 7, it may be considered that a pair of idle gears 55A which is arranged to be brought into engagement with the gear 54 and 55B which is arranged to be brought into engagement with the heat roller gear 56 are coaxially provided on the shaft 15 at the rocking center of the heat roller 11, and a one-way clutch structure 55C is provided between the shaft 15 and one of the idle gears 55A and 55B. In the drawing of FIG. 7, the one-way clutch structure 55C is provided between the shaft 15 and the idle gear 55B. In this arrangement, it becomes possible to make the shortening of backlash between the idle gear 55A and the gear 54 smaller when driving force is undesirably transmitted from the heat roller 11 to the idle gear 55B.

The well-known gear including a one-way clutch structure employed in the above-described embodiments are arranged in such a manner-that rotating force along only one direction is transmitted.

As described above, with a sheet warp prevention mechanism according to the present invention, it becomes possible to prevent warp of the continuous sheet when the continuous sheet is fed since the heat roller is arranged not to be reversely rotated, further, driving force is not transmitted from the heat roller to the driving system. Accordingly, it becomes possible to prevent disturbance of a toner image having been not yet fixed and wrinkles of the continuous sheet caused by the warp.

The present disclosure relates to subject matter contained in Japanese Patent Application No. HEI 02-85976 (filed on Mar. 30, 1990) which is expressly incorporated herein by reference in its entirety.

What is claimed is:

1. A sheet warp prevention mechanism adapted to be positioned in an imaging device for forming a visible image by an electrophotographic method, said imaging device comprising a pair of rollers each having a central axis about which each of said rollers is rotatable, said pair of rollers adapted to be brought into and out of contact with each other in accordance with a rocking operation of one of said pair of rollers about a predetermined shaft member for fixing a toner image formed on a continuous sheet, said one of said pair of rollers being arranged to be rotated in a predetermined direction for feeding said continuous sheet with a gear member coaxially provided with said one of said pair of rollers which is brought into engagement with another gear member coaxially provided with said shaft member, a driving source member for driving both said one of said pair of rollers and a feeding member for feeding the continuous sheet toward said pair of rollers, and a transmitting mechanism for transmitting the driving force toward said pair of rollers;

said sheet warp prevention mechanism comprising inhibiting means, provided between said transmitting mechanism and said another gear member, for inhibiting a transmission of rotating force of said one of said pair of rollers to said transmitting mechanism, wherein said inhibiting means further comprises means for preventing at least one of said rollers from rotating about said central axis of said at least one roller in a direction opposite to said predetermined direction when said rollers are brought into contact with each other.

2. The sheet warp prevention mechanism according to claim 1, wherein said transmitting mechanism comprises a pair of timing pulley members and a third gear member provided on another shaft member which is distinct from said predetermined shaft member, said timing pulley member being arranged to be driven to rotate by said driving source member, and wherein said inhibiting means comprises a one-way clutch structure.

3. The sheet warp prevention mechanism according to claim 2, wherein said another gear member comprises an idle gear member, and wherein said one-way clutch member is provided on an inner side of said third gear member.

4. The sheet warp prevention mechanism according to claim 2, further comprising fourth gear member coaxially provided with said another gear member, said fourth gear member being brought into engagement with said third gear member, and wherein said one-way clutch structure is provided on an inner surface of said another gear member.

5. The sheet warp prevention mechanism according to claim 1, wherein said one of said pair of rollers comprises a heat roller arranged to be heated up to a predetermined temperature.

6. The sheet warp prevention mechanism according to claim 1, further comprising another inhibiting means for inhibiting rotation of said one of said pair of rollers in the opposite direction of said predetermined direction.

7. The sheet prevention mechanism according to claim 6, wherein said another inhibiting means comprises another one-way clutch structure coaxially provided with fifth gear member arranged to be brought into engagement with said gear member in case that said pair of rollers are brought into engagement with each other.

8. A sheet warp prevention mechanism adapted to be positioned in an imaging device for forming a visible image by an electrophotographic method, said imaging device comprising a pair of rollers each having a central axis about which each of said rollers is rotatable, said pair of rollers adapted to be brought into and out of contact with each other for fixing a toner image formed on a continuous sheet, said one of said pair of rollers being arranged to be rotated in a predetermined direction for feeding said continuous sheet with a gear coaxially provided therewith which is brought into engagement with another gear coaxially provided with a shaft;

said sheet warp prevention mechanism comprising an inhibiting means for inhibiting rotation of said one of said pair of rollers in the opposite direction of said predetermined direction, wherein said inhibiting means further comprises means for preventing at least one of said rollers from rotating about said central axis of said at least one roller when said rollers are brought into contact with each other.

9. The sheet prevention mechanism according to claim 8, wherein said inhibiting means comprises a one-way clutch structure coaxially provided with said another gear arranged to be brought into engagement with said gear in case that said pair of rollers are brought into engagement with each other.

10. A sheet warp prevention mechanism adapted to be positioned in an imaging device, said imaging device comprising a pair of rollers each having a central axis about which each of said rollers is rotatable, said pair of rollers adapted to be brought into and out of contact with one another, means for feeding a continuous-form recording sheet, means for moving at least one of said pair of rollers toward and away form the other of said pair of rollers, means for driving said means for feeding and said means for moving, wherein said drive means is always mechanically connected to said means for feeding, said means for moving and at least one of said rollers, means for preventing transmission of a rotational force which is generated when said pair of rollers moves towards or away from one another, and for preventing at least one of said rollers from rotating about said central axis of said at least one roller in a direction opposite to said predetermined direction when said rollers are brought into contact with each other.

11. The sheet warp prevention mechanism of claim 10, wherein said means for preventing transmission of rotational force comprises a one-way clutch.

12. The sheet warp prevention mechanism according to claim 10, further comprising a transmitting mechanism for transmitting a driving force to said pair of rollers; and said preventing means provided between said transmitting mechanism and said one of said rollers.

13. The sheet warp prevention according to claim 11, further comprising an inhibiting member provided for inhibiting rotation of said one of said pair of rollers in the opposite direction of said predetermined direction.

14. The sheet warp prevention mechanism according to claim 1, further comprising means for moving at least one of said pair of rollers toward and away from the other of said pair of rollers.

15. The sheet warp prevention mechanism according to claim 8, further comprising means for moving at least one of said pair of rollers toward and away from the other of said pair of rollers.

16. The sheet warp prevention mechanism according to claim 1, wherein said inhibiting means inhibits a transmission of rotating force which is generated when said pair of rollers moves towards or away from one another.

17. The sheet warp prevention mechanism according to claim 8, wherein said inhibiting means inhibits a transmission of rotating force which is generated when said pair of rollers moves towards or away from one another.

18. A sheet warp prevention mechanism adapted to be positioned in an imaging device, comprising:

a pair of rollers, and means for mounting said rollers for movement into and out of contact with each other, a gear member coaxially provided with one of said rollers and arranged to rotate said one of said rollers in a predetermined direction for feeding a continuous sheet; and an inhibiting member operably connected to said gear member of one of said rollers to prevent rotation of said one of said roller in a direction opposite to said predetermined direction, whereby warping of the continuous sheet is inhibited.

19. The sheet warp prevention mechanism according to claim 18, further comprising a transmitting mechanism for transmitting a driving force to said pair of rollers; and said inhibiting member provided between said transmitting mechanism and said one of said rollers.

20. The sheet warp prevention mechanism according to claim 19, further comprising another inhibiting member provided for inhibiting rotation of said one of said pair of rollers in the opposite direction of said predetermined direction.

21. A sheet warp prevention mechanism adapted to be positioned in an imaging device, comprising:

first and a second rollers each having a central axis about which each of said rollers is rotatable and means for mounting at least one of said rollers to be movable into and out of contact with each other, said rollers feeding a continuous sheet in a predetermined feeding direction when said rollers are in contact with each other;

means for supporting first, second and third shafts parallel to each other and to the central axes of said first and second rollers, said second roller rotatably supported by said supporting means;

said mounting means comprising an arm member pivotally supported by said first shaft, said first roller rotatably supported by said arm member for movement into and out of contact with said second roller;

a first gear supported by said first shaft, a second gear supported by said second shaft, a third gear fixedly secured to said first roller, said first gear engaging said second and third gears;

a fourth gear supported by said third shaft;

transmitting means for transmitting a driving force to said rollers, a first one-way clutch coupling said transmitting means to said second gear;

said first one-way clutch comprising means for providing a driving force from said transmitting means in the predetermined feeding direction and for inhibiting providing a driving force along a direction opposite to the predetermined feeding direction; and a second one-way clutch coupling said third gear to said fourth gear, said second one-way clutch comprising means for inhibiting rotation of said first roller in a direction opposite to said predetermined feeding direction.

* * * * *

UNITED STATES PATENT AND TRADEMARK OFFICE

CERTIFICATE OF CORRECTION

PATENT NO. : 5,365,320

DATED : November 15, 1994

INVENTOR(S) : Masatoshi TAKANO et al.

It is certified that error appears in the above-indentified patent and that said Letters Patent is hereby corrected as shown below:

On the cover sheet, in section [57], line 18 of the abstract, change "include" to ---includes---.

At column 10, line 51 (claim 10, line 9), change "form" to ---from---.

Signed and Sealed this

Eighteenth Day of July, 1995

*Attest:*

*Attesting Officer*

BRUCE LEHMAN

*Commissioner of Patents and Trademarks*